United States Patent [19]

Ewert et al.

[11] Patent Number: 4,977,843

[45] Date of Patent: Dec. 18, 1990

[54] SAIL TENSIONING APPARATUS

[76] Inventors: Charles F. Ewert, 4218 Marylebone Way, Boise, Id. 83704; Joseph D. Grooms, 2092 Parkside Dr., Boise, Id. 83712

[21] Appl. No.: 398,930

[22] Filed: Aug. 28, 1989

[51] Int. Cl.[5] ..... B63B 35/79; B63H 9/04

[52] U.S. Cl. ..... 114/109; 114/39.2; 114/108

[58] Field of Search ..... 114/39.2, 109, 108

[56] References Cited

U.S. PATENT DOCUMENTS

| | | | |
|---|---|---|---|
| 3,040,690 | 6/1962 | Harless | 114/108 |
| 3,866,559 | 2/1975 | Joensen | 114/108 |
| 4,266,495 | 5/1981 | Hood | 114/108 |
| 4,280,432 | 7/1981 | Dessel | 114/109 |
| 4,807,550 | 2/1989 | Marker | 114/109 |

FOREIGN PATENT DOCUMENTS

| | | | |
|---|---|---|---|
| 0257410 | 3/1988 | European Pat. Off. | 114/109 |
| 3324900 | 10/1984 | Fed. Rep. of Germany | 114/109 |
| 2594790 | 8/1987 | France | 114/109 |
| 665917 | 2/1952 | United Kingdom | 114/109 |

*Primary Examiner*—David H. Brown
*Attorney, Agent, or Firm*—Paul F. Horton

[57] ABSTRACT

Self locking apparatus for quick and convenient tensioning of the luff of a sail of a sailboard. In a first embodiment, the tack of the sail is attached to the mastbase close to the hull of the sailboard and the head of the sail is attached to the apparatus of the invention. The invention includes a cap for placement over and receiving the top of the sailboard mast, a lever pivotally engaging the cap; and an adjustment strap connecting the head of the sail to a cross bar on the lever. The lever brings the strap in a self locking position over center for tensioning the luff of the sail. In a second embodiment, the head of the sail is attached in conventional manner to the top of the mast and the lever is positioned by means of a sleeve to the bottom of the mast. Once again, the lever rotates to an over-center self-locking position for tensioning the luff of the sail.

11 Claims, 4 Drawing Sheets

SAIL TENSIONING APPARATUS

BACKGROUND OF THE INVENTION

1. Field of the Invention

This invention relates, generally, to sailboards and pertains, more specifically, to apparatus for placing tension on the luff of the sail.

2. Description of the Prior Art

Sailboarding is presently increasing in popularity partly because it is generally easier to transport and to rig than any other type of sailing apparatus. As with conventional sailing craft, sailboards derive their power from a sail utilizing a mast for luff tension and a boom for leech tension to contour the sail for optimum propulsion.

Since sailboarding is an extension of the ancient art of sailing, numerous structures for rigging a sailboard are similar to the time tested methods of conventional sailboats, i.e., block and tackle structures. Simply stated, the rigging process involves three major steps: The attaching of the sail to the ends of the mast and removing the slack in the luff; mounting the boom to the mast and attaching the clew of the sail to the opposite end of the boom; and applying the final tension to the luff. A block and tackle structure is commonly used for all these tensioning operations, but such procedure with block and tackle structure is generally cumbersome, time consuming, and generates excess line to be stowed.

In that sailboarding is conducted in a variety of wind speed conditions, anything from light breezes to gale winds, the operator must accommodate this diversity by matching the size of the sail to the conditions. Since wind speed can fluctuate widely during any sailboard outing, the operator must often spend time rerigging.

While quick release levers have been used for interconnecting stays on sailboats, no such device is known for placing selective tension on the luffs of sailboard sails. Stays are used to support the mast of a sailboat with respect to the hull of the boat and are not used nor useable with sailboards. Both U.S. Pat. No. 3,866,559, issued to R. Joensen and U.S. Pat. No. 4,280,432, issued to T. Dessel, show an interconnect between the deck of a sailboat and a stay for quick release of the stay.

SUMMARY OF THE INVENTION

The present invention includes a mast attachment member; a sail attachment member; and an over-center lever for placement of selective tension on the luff of a sail of a sailboard. A more thorough description may be found in the appended claims. The present invention overcomes the problems associated with conventional sailboard rigging apparatus by providing apparatus which reduces rigging time; which is relatively simple, durable, economical, and is readily adapted to various sail sizes.

It is therefore a primary object of the present invention to provide quick lock and release apparatus for tensioning the luff of a sail onto the mast of a sailboard.

It is another object of the present invention to provide structure which permits safe tensioning of the sail luff.

Another object of the present invention is to provide apparatus for tensioning the luff of a sail providing a mechanical advantage so that the luff may be tensioned with a minimum of effort.

Yet another object of the present invention is to provide apparatus for tensioning the luff of a sail without the use of block and tackle, thus avoiding the necessity to stow excess line generated in the tensioning process.

Still another object of the present invention is to provide apparatus for tensioning the luffs of sails of varying sizes.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
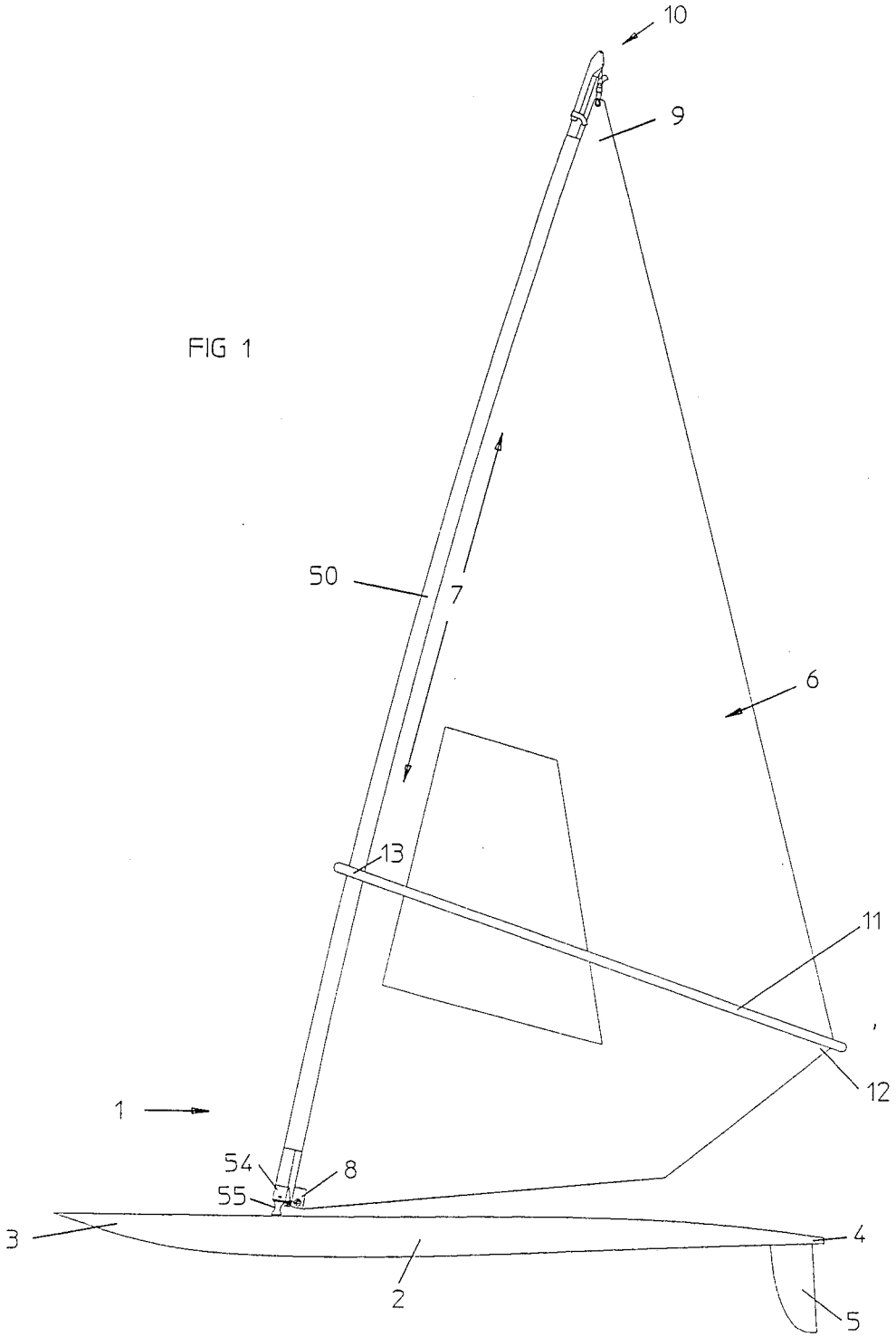
FIG. 1 is an elevation of a fully rigged sailboard employing a first preferred embodiment of the luff tensioning apparatus of the present invention.

Referring now to the drawings, FIGS. 1–5, and, more particularly to FIG. 1, a first embodiment to be preferred of sail luff tensioning apparatus 10, made according to the present invention, is disclosed. Apparatus 10 is used on a sailboard 1, having a hull 2, mast 50, and a sail 6. Hull 2 includes a bow 3 and a stern 4. A skeg or fin 5 is affixed to the stern in a conventional manner. Sail 6 is supported along the luff 7, designated by the arrows, by means of a luff sleeve from tack 8 of sail 6 to head 9 of the sail on mast 50. The mast extends generally upwardly in a vertical plane. A boom 11, straddling sail 6, extends laterally from the mast to the clew 12 of the sail. A fork 13 is integral with the one end of the boom 11 and engages the mast 50 in such a way that the fork end of the boom can be adjusted vertically along the mast but is constrained from moving longitudinally away from the mast or transversely outside the vertical plane of the mast and boom.

The mast is constrained at the bottom by a mastbase 54 which, in turn, is attached conventionally to a universal unit 55, allowing the mast to freely pivot and swing about the universal unit's longitudinal axis of rotation. The opposite end of the universal unit 55 is attached to the longitudinal centerline of the top of hull 2. Tack 8 of sail 6 is attached to mastbase 54 in conventional manner Referring now, more particularly, to FIGS. 2–5, the first embodiment of quick-lock, luff tensioning apparatus 10 may be seen to advantage. Apparatus 10 includes mast attachment means, designated generally by the numeral 20; lever 30; and sail engagement means, designated generally by the numeral 40.

Mast attachment means 20, in the first embodiment, includes a cap 23 which is of hollow cylindrical cup-shaped configuration for sliding snugly over the top of mast 50. Cap 23 has two protrusions 27 that extend upwardly and outwardly along two planes tangent to the body of cap 23 and parallel to that plane defined by mast 50 and boom 11, shown in FIG. 1. Affixed to and extending between protrusions 27 are one or more pivot pins 28 permitting a 180 swing of lever 30, as shown by the arrow in FIG. 2.

At the apex of lever 30 is a crossbar 43. A handle 31 of lever 30, opposite pivot pin 28 from crossbar 43, is of sufficient length to yield a significant mechanical advantage and is C-shaped in cross section to conform to the cylindrical mast 50 and cap 23.

The head 9 of sail 6 is attached to lever 30 by means of a strap 45. The strap is made of one continuous length of flat, flexible, high strength, wear and weather resistant, woven, and web-type material such as nylon. A ladderlock buckle 42 is secured to the strap by folding over and sewing one end of the strap to itself. Strap 45 forms a closed loop extending from a grommet 60 in the head 9 of the sail to the crossbar 43 at the apex of lever 30. With the lever in the pretensioned position, FIG. 2, the loop can easily be adjusted to remove any slack in luff 7 of the sail and to accommodate various sail sizes.

Figure 2:
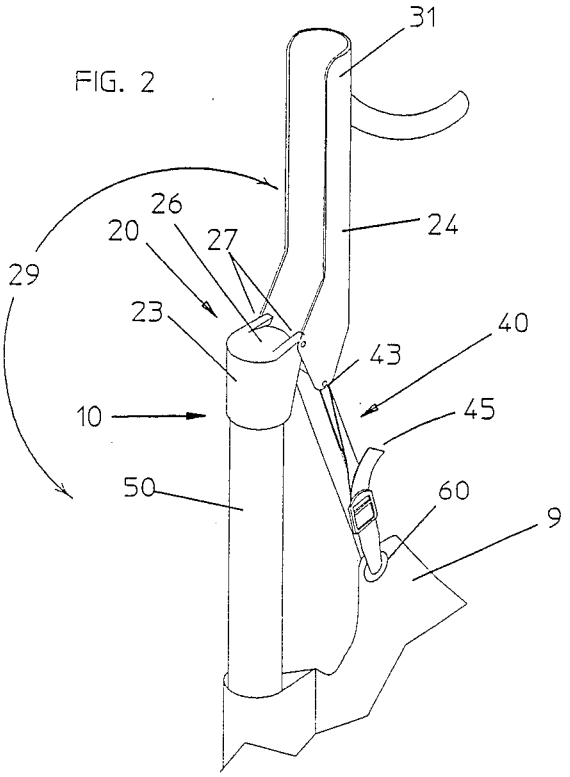
FIG. 2 is a perspective view of the apparatus shown in FIG. 1, with the lever in the pretension position.
Figure 3:
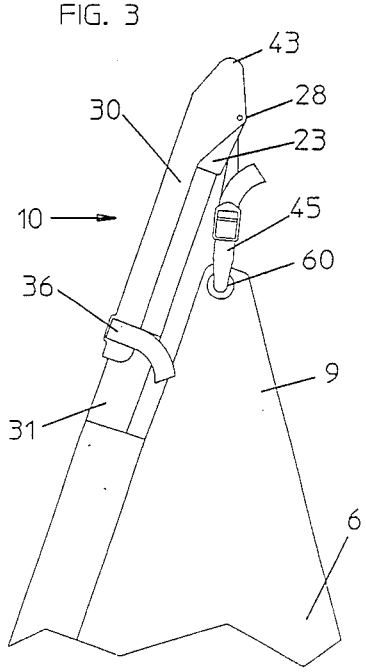
FIG. 3 is a composite elevation of the apparatus shown in FIG. 1, with the lever in the tensioning position.
Figure 4:
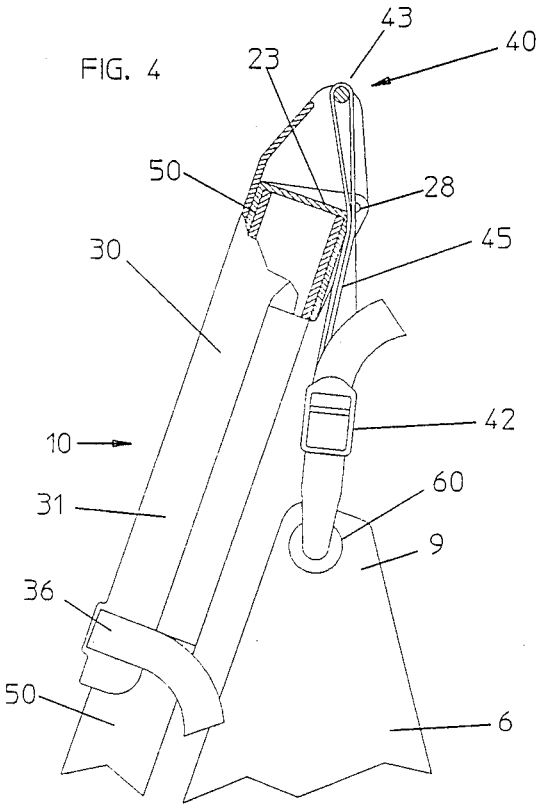
FIG. 4 is the elevation shown in FIG. 3, in partial section.
Figure 5:
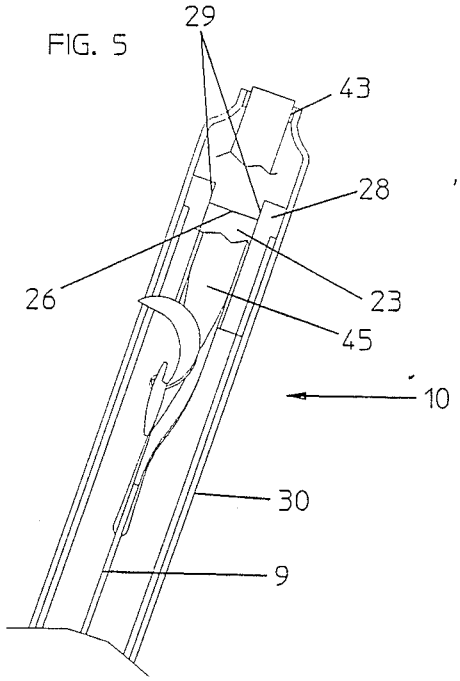
FIG. 5 is a frontal view, in partial section, of the apparatus shown in FIG. 1.

After boom 11 is attached to mast 50 in a conventional manner and clew 12 of the sail is properly tensioned, lever 30 is rotated 180 from the position shown in FIG. 2 to the tensioned position show in FIGS. 3, 4, and 5, providing the proper amount of tension to luff 7 of the sail.

With lever 30 in the tensioned position, the apparatus is in a self locking position. Referring to FIG. 5 in particular, it will be seen that the opposing inside surfaces 29 of the two protrusions 27 and the outside surface of the top of the cylindrical cap 23 form a trough 26 of proper width to align strap 45 in a flat position against the cap 23. The trough is of sufficient depth to allow both members of the strap 45 to pass over center of the pivot pins 28 of lever 30 causing the tension in the strap to lock the lever in the tensioned position, shown to advantage in FIG. 4. To prevent accidental unlocking of the lever during rigorous sailing conditions, a retaining strap 36, affixed to handle 31 of lever 30, is secured around mast 50, as shown in FIGS. 3 and 4.

Figure 6:
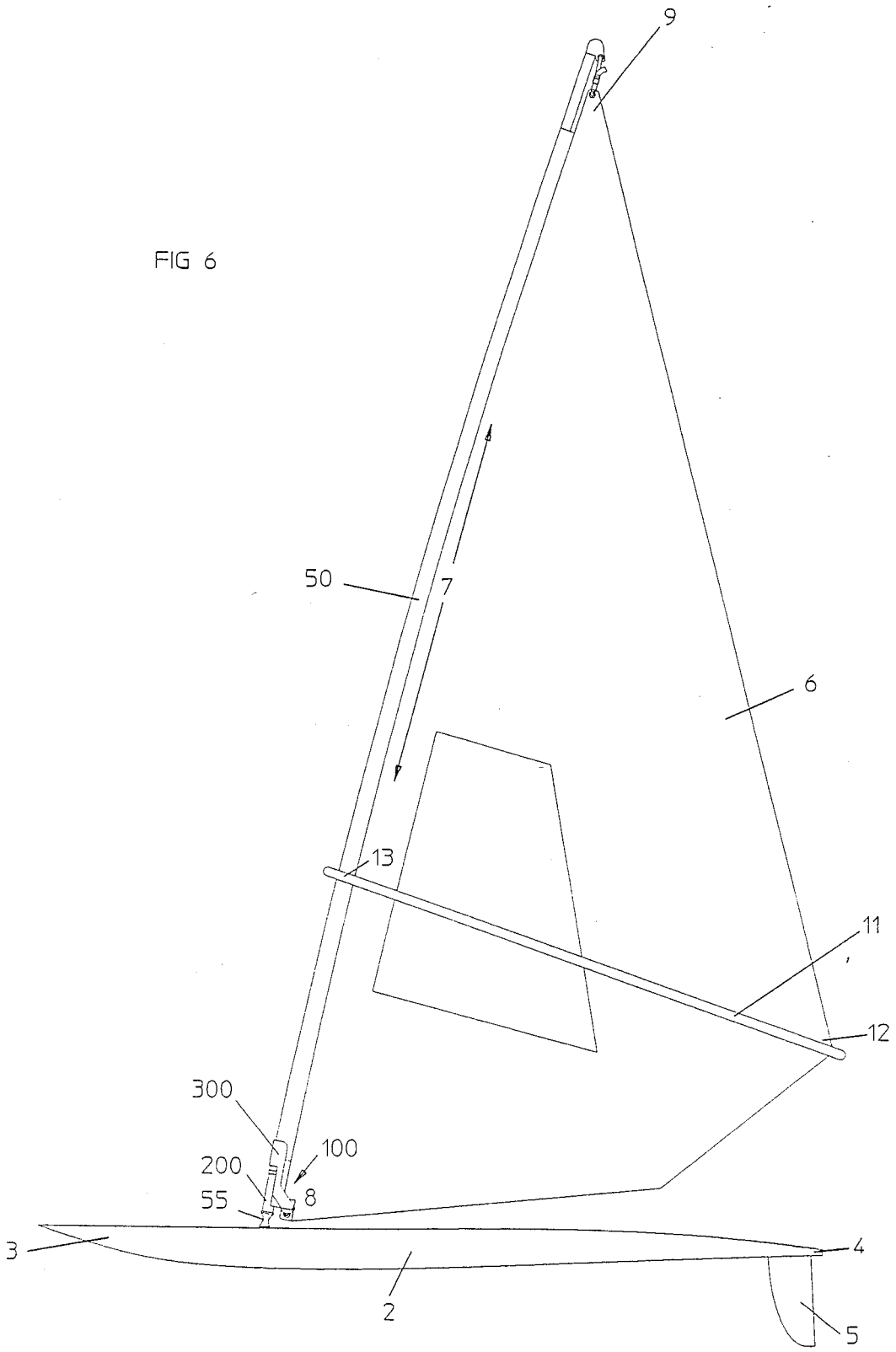
FIG. 6 is an elevation of a fully rigged sailboard employing a second embodiment of the luff tensioning apparatus of the present invention.
Figure 7:
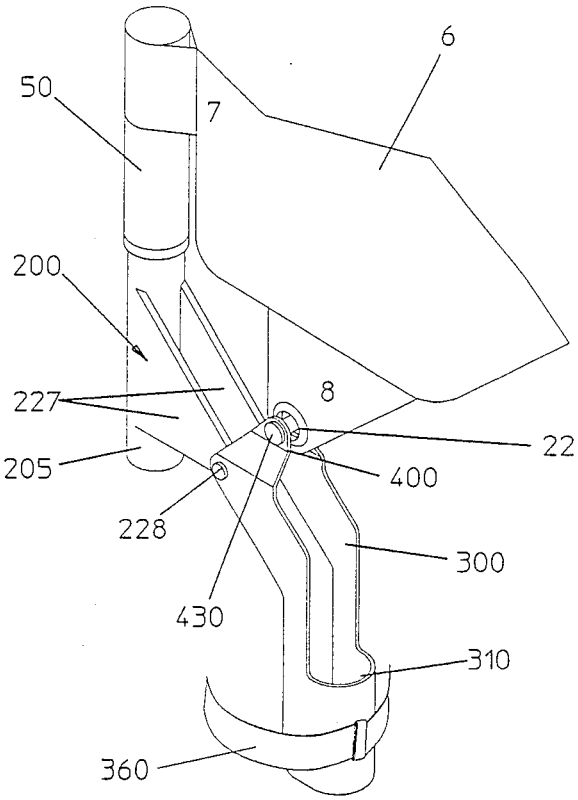
FIG. 7 is a perspective view of the apparatus shown in FIG. 6, with the lever in the pretensioned position.
Figure 8:
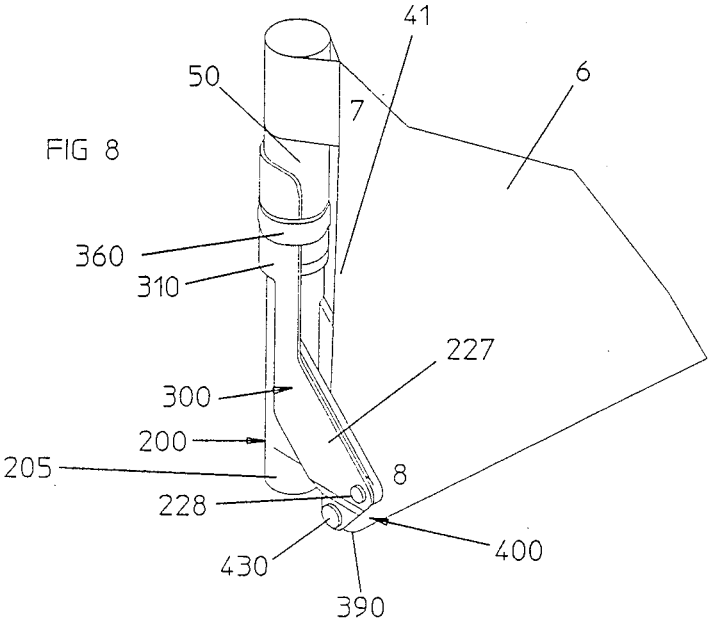
FIG. 8 is a perspective view of the apparatus shown in FIG. 6, with the lever in the tensioned position.

Referring now to FIGS. 6–8, a second embodiment of quick-lock, luff tensioning apparatus 100 may be seen to advantage. Apparatus 100 includes mast attachment means 200; lever 300; and sail engagement means 400.

Head 9 of sail 6 is attached to the top of mast 50 in a conventional manner. Lever 300, pivotally mounted to mast 50 by attachment means 200 is used to tension the luff 7 of the sail. Lever 300, as in the first embodiment, employs an over-center action as depicted in FIGS. 7 and 8.

Attachment means 200 includes a tubular portion 205 which may be received by the mast as shown. Tubular portion 205 has two protrusions 227 extending outwardly along two planes tangent to the body of the tubular portion and parallel to that plane defined by mast 50 and boom 11, as shown in FIG. 6. These protrusions are provided with one or more pivot pins 228 for the pivoting of lever 300. From pins 228, the lever extends outwardly to define a C-shaped handle 310 which conforms to the cylindrical shape of mast 50. At the apex 390 of the lever 300, a latch 430, in the form of a pin, hook, keeper, or the like, attaches lever 300 to the grommet 22 at tack 8 of sail 6. Tensioning the luff 7 of the sail 6 is accomplished by rotating the lever 300 from the position shown in FIG. 7 to the position shown in FIG. 8. This rotation is made with the mast disconnected form the universal unit 55. During this rotation, the edge 41 of the sail slips between the two protrusions 227 on sleeve 205, allowing the lever to obtain an over-center locked position. Securing strap 360 is shown to prevent the lever from accidental unlocking.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. Apparatus for placing selective tension on the luff of a sail of a sailboard having a hull, mast, and sail, said apparatus comprising:

mast attachment means;

a lever pivotally mounted to said mast attachment means by pivot means, said lever provided with an elongated hand portion; and sail engagement means for connecting the sail to said lever, said lever movable from a tension free position to an over-center, self locking position for placing tension on the luff of the sail.

2. The apparatus as described in claim 1 wherein said mast attachment means comprises a cap for placement over and for receiving the top of the mast.

3. The apparatus as described in claim 1 wherein said handle portion of said lever is substantially C-shaped in cross section for partial encirclement of the mast when said lever is in the locked position.

4. The apparatus as described in claim 1 further comprising a lever handle retention strap for strapping said lever handle to the mast when said lever is in the locked position.

5. The apparatus as described in claim 1 wherein said mast attachment means engages the bottom of the mast and wherein said sail engagement means comprises a latch operable to engage the tack of the sail.

6. The apparatus as described in claim 1 wherein said sail engagement means comprises a strap engagement cross bar affixed to said lever parallel with said pivot means and an adjustable strap, at one end engaging said crossbar and at the opposing end engaging the sail.

7. The apparatus as described in claim 6 wherein said mast attachment means is provided with a strap trough for receiving said strap when said lever is in an over-center position.

8. Apparatus for placing tension on the luff of a sail of a sailboard having a hull, mast, and sail, said apparatus comprising:

mast attachment means including a cap for placement over and for receiving the top of the mast; the top of said cap provided with a pair of opposing and parallel protrusions defining a trough therebetween;

a lever pin mounted to said protrusions;

a lever pivotally mounted on said lever pin; said lever provided with an elongated handle portion on one side of said pin and a strap engagement cross bar on the opposing side of said pin; and an adjustable strap affixed at one end to said cross bar and at an opposing end to the head of the sail, said strap receivable within the trough of said cap and said lever movable from a tension free position to an over-center self locking position for placing selected tension on the luff of the sail.

9. The apparatus as described in claim 8 wherein said handle portion of said lever is substantially C-shaped in cross section for partial encirclement of the mast when said lever is in the locked position

10. The apparatus as described in claim 8 further comprising a lever handle retention strap for strapping said lever handle to the mast when said lever is in the locked position.

11. Apparatus for placing tension on the luff of a sail of a sailboard having a hull, mast, and sail, said apparatus comprising:

mast attachment means for engaging the bottom of the mast; and a lever pivotally mounted to said mast attachment means by pivot means, said lever provided with an elongated hand portion on one side of said pivot means and a latch on the opposing side of said pivot means, said latch operable to engage the tack of the sail; said lever movable from a tension free position to an over-center self-locking position for placing selected tension on the luff of the sail.

* * * * *